United States Patent [19]

Stacey

[11] Patent Number: 4,542,855

[45] Date of Patent: Sep. 24, 1985

[54] AGRICULTURAL SPRAYING DEVICE

[75] Inventor: Robert E. Stacey, Sellicks Hill, Australia

[73] Assignee: Micro Spray (Australia) Pty. Ltd., Hackham, Australia

[21] Appl. No.: 550,205

[22] Filed: Nov. 9, 1983

[30] Foreign Application Priority Data

Nov. 12, 1982 [AU] Australia ..... PF6771

[51] Int. Cl.[4] ..... B05B 5/00

[52] U.S. Cl. ..... 239/690; 239/124

[58] Field of Search ..... 239/690, 695–708, 239/77, 124; 361/226, 227, 228

[56] References Cited

U.S. PATENT DOCUMENTS

| | | | |
|---|---|---|---|
| 2,979,269 | 4/1961 | Bals | 239/77 |
| 3,339,840 | 9/1967 | Point | 239/3 |
| 3,794,243 | 2/1974 | Tamny et al. | 239/3 |
| 3,929,286 | 12/1975 | Hastings et al. | 239/3 |
| 3,934,055 | 1/1976 | Tamny et al. | 239/3 |
| 4,198,781 | 4/1980 | Dykes | 239/3 |

FOREIGN PATENT DOCUMENTS

| | | |
|---|---|---|
| 475120 | 6/1973 | Australia . |
| 521016 | 7/1977 | Australia . |
| 63814/80 | 10/1980 | Australia . |
| 79851/82 | 1/1982 | Australia . |

*Primary Examiner*—Andres Kashnikow
*Assistant Examiner*—Scott D. Malpede
*Attorney, Agent, or Firm*—Cushman, Darby & Cushman

[57] ABSTRACT

An agricultural spraying machine in which the liquid to be sprayed is electrostatically charged in bulk in the liquid tank. A pump passes the liquid through an electrostatic charging unit to a spraying or atomizing nozzle or head, part of the charged liquid being recirculated by a regulator by-pass valve through the tank to charge the liquid in the tank.

4 Claims, 3 Drawing Figures

AGRICULTURAL SPRAYING DEVICE

This invention relates to an agricultural spraying device, more particularly the electrostatic spraying of insecticides, pesticides, herbicides and fungicides.

BACKGROUND OF THE INVENTION

The electrostatic spraying of liquids and powders for the coating of articles, such as spray painting and the like is well known, and it is only recently that this has been extended to other areas.

Australian Patent Specification No. 475,120 is directed to the spraying from an airborne source, such as an aeroplane where a primary and secondary spray of material are concurrently emitted, both sprays being electrostatically charged of opposite polarity to preclude intermixing of the two sprays before the sprays are deposited. This specification discloses that the liquid is first atomized and then charged, or a liquid is vapourised, the vapour saturating a moving air flow then passes through an electrogasdynamic type channel to produce extremely small sized charged particles.

Australian Patent Specification No. 26794/77 discloses the spraying of pesticides in which a spray head has a conducting or semiconducting surface to which a potential is applied, a field intensifying electrode being mounted adjacent the surface which electrode is earthed, so that the electrostatic field causes liquid to atomize to form electrically charged particles to be projected past or away from the electrode.

Australian Patent Specification No. 63814/80 is directed to a rotating spray head with a circular induction electrode disposed adjacent to the spray head rim, the spray head rotating to produce the desired spray from the spray head.

Australian Patent Specification No. 79851/82 discloses an agricultural sprayer, there being provided means to produce a descending cloud of charged pesticide particles and further elements being electrically connected to a potential spaced from the spray head so that there is little or no tendency for the charged particles to contaminate the operator.

The spraying devices in the agricultural field thus utilize electrodes which atomize the sprayed particles, and these electrodes are often exposed from the spray head, and various other units rely on the coronal discharge for charging the particles.

U.S. Pat. Nos. 4,073,712, 4,073,273 and 4,199,430 disclose the application of an electrostatic field to a flow of liquid through a cylinder.

U.S. Pat. No. 2,975,757 shows electrostatic spraying by charging the sprayed material by impinging the droplets on a rotating charged element, so that the droplets are charged as they impinge on the element and are thrown therefrom.

U.S. Pat. No. 2,899,136 is directed to electrostatic paint spraying apparatus where a centrifugal distributor is charged, the paint being fed to the distributor to be charged and distributed therefrom.

U.S. Pat. No. 3,031,145 discloses an electrostatic paint spraying apparatus, wherein a conventional spray gun is charged, the paint being charged in a pool as it passes to and through the gun.

U.S. Pat. No. 3,117,029 discloses an electrostatic coating apparatus wherein an electrical potential between the spray nozzle and the object being coated provided.

U.S. Pat. No. 3,127,112 discloses the spraying of a paint and a solvent, the solvent spray head having a potential applied thereto to provide a potential difference between the solvent spray head and the object being coated, the solvent being sprayed into the paint spray emitter from the paint spray head.

U.S. Pat. No. 4,185,783 discloses the spraying of a powder, an electrical potential being applied to the powder in a supply hose to the spray gun to prevent clumps of powder adhering to the supply hose.

BRIEF STATEMENT OF THE INVENTION

It is an object of the invention to provide an agricultural spraying device in which the material to be sprayed is not first atomized or dispersed as droplets for action by the electrostatic field, and in which the electrodes for charging elements are not exposed.

Thus there is provided according to the invention an agricultural spraying device having a supply tank for the liquid being sprayed, and in which means are provided to pass the liquid to be sprayed through an electrostatic unit to charge the liquid, the liquid then passing through a non-electrically conductive line to an atomizer whereby the charged atomized particles are attracted to the plants or crop being sprayed.

DESCRIPTION OF THE PREFERRED EMBODIMENT

Figure 1:
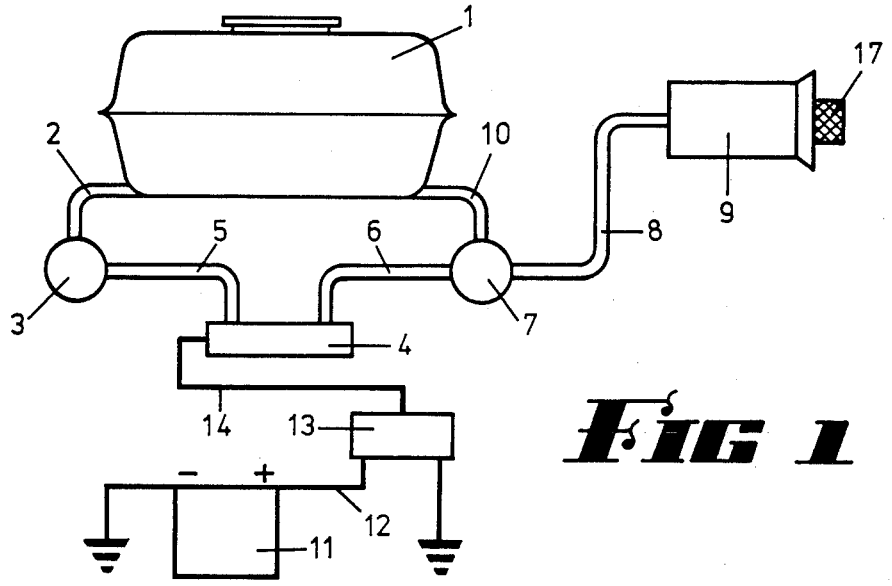
FIG. 1 shows a schematic view of the spraying apparatus.
Figure 2:
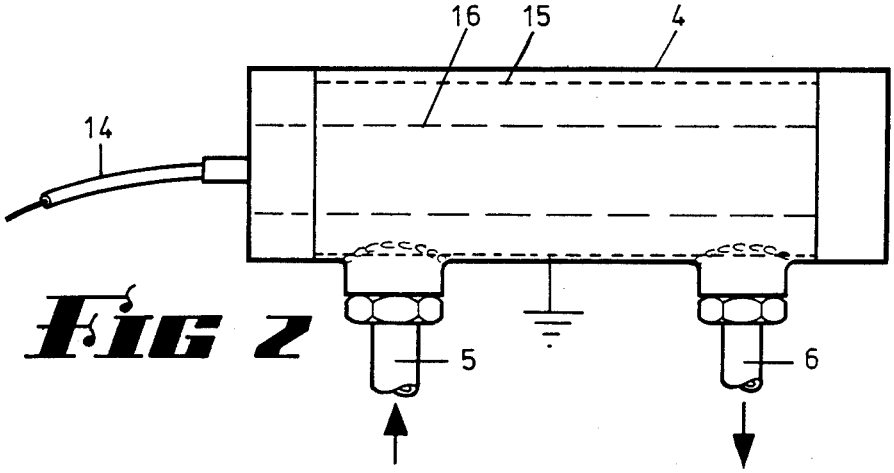
FIG. 2 shows a view of the charging unit.
Figure 3:
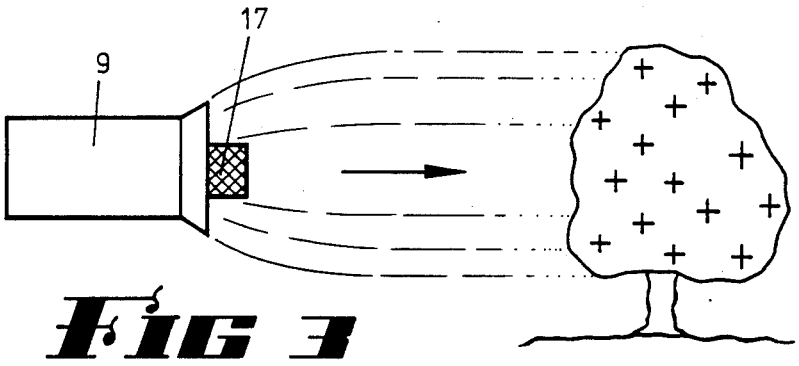
FIG. 3 shows the flow of charged material to the tree or plant being sprayed.

Referring to the figs, the apparatus comprises a tank 1 to contain the liquid being sprayed, the tank being of insulating materials such as one of the suitable plastics materials. Alternatively the tank can be insulated to ensure that it is insulated from the rig on which the spraying apparatus is mounted.

An outlet pipe 2 is connected to a pump 3 which delivers the liquid to be sprayed to the electrostatic charging unit 4 by pipe 5. A further pipe 6 passes the charged liquid to a regulator by-pass valve 7, this delivering the liquid via pipe 8 to the atomising unit 9, and recirculating the by-pass liquid through by-pass pipe 10 back to the tank 1.

A battery 11 is connected by electrical line 12 to a step up transformer 13, which in turn is electrically connected to the charging unit 4 by line 14, the charging unit being earthed to complete the circuit.

The charging unit 4 comprises a pair of concentric cylindrical electrodes 15,16 with a fluid flow passage therebetween so that when a potential is applied to the electrodes the fluid flowing there between is electrostatically charged. The potential applied can be in the order of 50,000 volts.

The rotary atomizer 9 comprises a fan in a duct the liquid issuing from a screen 17 into the air flow. The screen 17 at the discharge end of the duct rotates with the fan so that the screen due to its rotation finely atomizes the liquid as it is sprayed into the air blast.

The electrostatic unit charges the fluid negatively so that the fluid droplets leaving the atomizer are negatively charged by the electrostatic charging unit.

The liquid is charged as it passes through the electrostatic unit, thus charging the liquid in the tank due to the by-pass valve. The spray formed is directed toward the target by an air blast provided by the fan driven by a hydraulic or electric motor, charged droplets being then directed in the correct direction toward the target.

As the droplets are negatively charged they will then be attracted toward the target since the target is of opposite potential to the droplets, it being found that it is not necessary to apply a potential to the target, that is the growing trees or crops.

Since the fluid is effectively charged in bulk in the tank, and the tank and the feed system to the rotary atomizer head is insulated from the rest of the unit, the problem of short circuiting the system due to electrostatic charge feedback is eliminated. Hence as all the liquid is charged before issuing from the spray head, the problem of the prior art devices is overcome, for with the prior art units, not all the droplets are charged after issuing from the spray head.

While the rotary atomizer produces micron sized particles, the electrically charged unit further breaks up the droplets into smaller micron size and these are broken up into a narrower sized spectrum than before.

This means that in order to maintain particle size the rotary head atomizer may be operated at a lower speed than before thus consuming less energy from the hydraulic system and in turn therefore further savings can be made in fuel.

Preferably the spraying device can utilize a plurality of spray heads with the heads being hydraulically driven by a hydraulic motor the heads being either set at a fixed angle, or can be caused to oscillate as desired. It has been found that in tests using the unit the spray plume from the heads when electrically charged was remarkably straighter and more direct compared with the spray plume from the heads which were not electrically charged. It is further observed that the swirl of spray at the periphery of the spray head was virtually eliminated so that recycling of the spray which can occur without electrostatic charging was virtually eliminated.

It has been observed that the plume was definitely attracted to the tree and thus it was clearly observed that as the unit passed between trees the plume could be seen to almost release itself from the tree it had just passed and bend over to the next tree as the field of influence became stronger on the next tree.

Samples taken from the trees were examined and it has been found that the electrically charged spray had a far greater coverage on the foliage than without the electrostatic treatment, the coverage was more even with greater uniformity of droplet size, and the undersides of the leaves were also observed to be covered to the same extent as the upper sides of the leaves.

Thus it will be seen that by the invention greater coverage of the leaves was obtained, and there was a minimum wastage of chemical spray to the atmosphere compared to the units operating without the electrostatic charge.

Although the invention as suggested was applied to rotary atomizers, the invention may also be applied to conventional spray nozzles by charging the liquid in the spray line or tank before the liquid passes through the spray nozzles so that the issuing droplets are then attracted to the target.

The spraying apparatus is preferably mounted on a vehicle to pass over or in close proximity to the crops, plants or trees being sprayed, the atomizers being suitably spaced and positioned depending upon the crop being sprayed. Also the invention can be applied to the spraying by aircraft with a plume which will be attracted to the trees and plants, these being closer to the aircraft than the ground.

The electrostatic unit can be supplied from a step-up transformer which can be operated by a standard 12 volt battery.

The claims defining the invention are claimed as follows:

1. An agricultural spraying machine mounted on a vehicle, said machine comprising an insulated supply tank for the liquid to be sprayed, a pump connected to an outlet of the tank, a pipe connecting the pump through an electrostatic charging unit to an atomizer, a regulator by-pass valve in the pipe between the electrostatic unit and the atomizer, a return pipe connected between the regulator by-pass valve and the tank to recirculate charged liquid through the tank, transformer means charging the electrostatic charging unit, said atomizer directing said charged atomized liquid to the crop being sprayed, said pipes, pump, by-pass regulator valve, electrostatic unit and atomizer being electrically insulated from the vehicle, whereby in operation the liquid in the tank becomes electrostatically charged to a potential opposite to a potential of the crops or trees being sprayed whereby all the atomized droplets are charged and attracted as a plume to the crop and trees being sprayed.

2. An agricultural spraying device having a supply tank for a liquid being sprayed, and in which means are provided to pass liquid through an electrostatic unit to charge the liquid, the iquid passing through a non-electrically conductive line to an atomizer whereby charged atomized particles are attracted to plants or crops being sprayed, characterized by a pump to withdraw the liquid from the supply tank and pass liquid through the electrostatic unit to the atomizer, a regulator by-pass valve situated in the spray line between the electrostatic unit and the atomizer, a return line connected between the regulator by-pass valve and tank whereby charged liquid is recirculated through the tank to thereby charge the liquid in the tank to ensure that the liquid as it passes to the atomizer is fully charged.

3. An agricultural spraying device as defined in claim 2, characterized in that the atomizer comprises means for ejecting liquid in fine droplets radially from a cylindrical rotating screen, a fan in a duct to direct an air blast over said cylindrical rotating screen.

4. An agricultural spraying device as defined in claim 2, characterized in that the electrostatic unit comprises a pair of concentric cylindrical electrodes mounted one within the other to form a flow passage therebetween for the charging of the fluid, a transformer applying a potential to the electrodes.

* * * * *